United States Patent [19]

Rothstein

[11] 4,254,723

[45] Mar. 10, 1981

[54] DECORATIVE STITCH FORMATION

[76] Inventor: Sheldon Rothstein, c/o N.Y. Sewing Machine, 30 W. 25th St., New York, N.Y. 10010

[21] Appl. No.: 945,207

[22] Filed: Sep. 25, 1978

[51] Int. Cl.[3] ..... D05B 47/04

[52] U.S. Cl. ..... 112/255; 112/79 A

[58] Field of Search ..... 112/79 R, 79 A, 255, 112/59, 97, 254, 220, 78, 163, 167, 158 E; 66/125 R, 146; 242/149, 150; 139/450; 74/194, 190

[56] References Cited

U.S. PATENT DOCUMENTS

| | | | |
|---|---|---|---|
| 485,546 | 11/1892 | Hunt | 112/255 |
| 670,078 | 3/1901 | Humphrey | 112/254 |
| 741,035 | 10/1903 | Hemleb | 112/163 |
| 851,082 | 4/1907 | Fischer | 112/255 X |
| 2,158,197 | 5/1939 | Pikul | 112/255 X |
| 2,191,046 | 2/1940 | Tiesler | 112/255 |
| 2,932,339 | 4/1960 | Odenweller | 112/79 A |
| 3,001,388 | 9/1961 | MacCaffray | 112/79 A X |
| 3,356,050 | 12/1967 | Urscheler | 242/150 |
| 3,906,876 | 9/1975 | Fitton | 112/79 A |
| 4,016,821 | 4/1977 | Minalaga | 112/158 E |

FOREIGN PATENT DOCUMENTS

| | | | |
|---|---|---|---|
| 1061966 | 3/1967 | United Kingdom | 112/79 R |

*Primary Examiner*—Werner H. Schroeder
*Assistant Examiner*—Andrew M. Falik
*Attorney, Agent, or Firm*—Robert W. Fiddler

[57] ABSTRACT

A sewing machine attachment and method for use in connection with multiple thread sewing machines to provide selective control of decorative stitch formation to selectively vary either pattern amplitude, or frequency of pattern repeat or both. A selectively adjustable variable speed drive is employed to drive a cam shaft carrying a plurality of selectively adjustable cams one for each thread forming the pattern which cams bear against a plunger acting to control the position of the selectively adjustable pressure plates forming the thread tensioners through which the threads of the machine are guided. By varying either speed and/or cam position and/or thread tensioner plate pressure different stitch formation can be obtained.

6 Claims, 2 Drawing Figures

DECORATIVE STITCH FORMATION

BACKGROUND OF THE INVENTION

This invention relates to the art of decorative stitch formation, and more particularly, to an improved sewing machine attachment, and method, permitting the use of a multiple thread sewing machine to obtain a variety of decorative stitch patterns.

The needle trades have long utilzed a variety of sewing machines and accessories to provide for decorative stitch patterns, and sewing machines have been evolved employing a variety of built in timing cams controlling either needle or thread movement to obtain a variety of decorative stitches. As is apparent, however, sewing machines formed with built in pattern cams and needles subject to movement in different needle paths, are relatively complex, increasing costs of manufacture, use and maintenance.

BRIEF DESCRIPTION OF THE INVENTION

It is with the above considerations in mind that the present improved means have been evolved providing a relatively simple sewing machine attachment, and method serving to permit the selective variation of stitch pattern, selectively changing either pattern amplitude, or frequency of pattern repeat without requiring utilization of relatively complex cams and cam follower mechanisms built into the machine or a change in needle path.

It is accordingly among the primary objects of this invention to provide improved means for obtaining decorative stitch patterns on a multiple thread sewing machine.

A further object of the invention is to provide a sewing machine attachment for use with multiple thread sewing machines to permit attainment of desired decorative stitch patterns without requiring modification of the sewing machine to which attached.

An additional object of the invention is to provide an improved method for forming decorative stitch patterns on a multiple thread machine.

A further object of the invention is to provide improved and simple means for utilizing a multiple thread sewing machine to produce decorative stitch patterns of selectively variable width or amplitude.

Another object is to provide improved and simple means for utilizing a multiple thread sewing machine to produce a decorative stitch pattern of selectively variable length or frequency of repeat per unit length of fabric sewed.

It is also an object to provide means for selectively varying the stitch pattern of a multiple thread sewing machine to change either or both frequency of repetition or amplitude of a stitch pattern.

These and other objects of the invention which will become hereafter apparent are achieved by controlling the thread tension and the frequency of change of thread tension. In accordance with the invention, it has been found that control of thread tension may be employed on a multiple thread machine to control the amplitude of distribution of any given thread in a stitch pattern or width of pattern. It has further been determined that the frequency of pattern repetition per unit length of fabric sewed or the length of the repeat pattern can be controlled by controlling intervals between thread tension release. Thus by controlling both frequency and amplitude of pattern, different patterns may be obtained. In accordance with the invention, this is done by providing a sewing machine attachment for use in connection with any mutliple thread machine permitting thread tension to be periodically varied by utilizing a variable speed drive to drive a cam shaft carrying a plurality of cams engaging plungers acting on the pressure plates of the thread tensioners through which the threads of the machines are passed. The length of each repeat pattern is determined by the frequency of thread tension release, or r.p.m. of the cam shaft, with high r.p.m.'s producing a small repeat. The width or amplitude of each repeat pattern is controlled by the tension, with looser tensions producing wider patterns.

A feature of the invention resides in the utilization of a simple attachment to a multiple thread sewing machine to produce stitch patterns in which there is selective control both of pattern amplitude or width and frequency of pattern repeat per unit length of fabric.

Another feature resides in the use of an auxiliary selectively adjustable speed control such as a ZERO MAX variable speed drive to selectively vary frequency of pattern repeat.

A further feature resides in the use of an auxiliary thread tensioner on an attachment to a multiple thread sewing machine, not requiring change of the machine to control switch pattern amplitude.

BRIEF DESCRIPTION OF THE DRAWINGS

The specific details of a preferred embodiment of the invention and of the manner and process of making and using it will be described in full, clear, concise, and exact terms so as to enable any person skilled in the art to make and use same, in conjunction with the accompanying drawings, wherein.

DESCRIPTION OF PREFERRED EMBODIMENT

Figure 1:
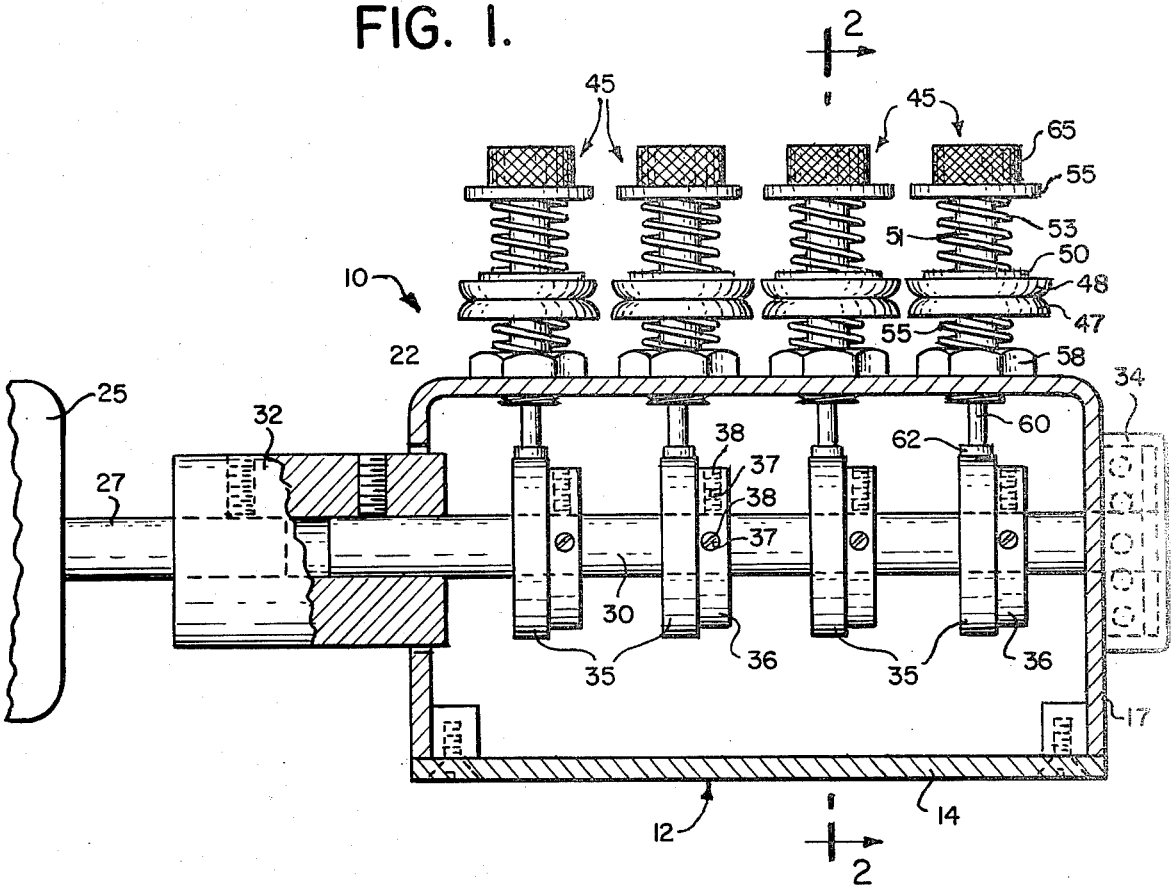
FIG. 1 is a schematic elevational view in vertical cross-section through a housing support for the attachment.

As illustratively shown in the drawings the invention may readily be practiced in connection with a simple sewing machine attachment 10 adapted for mounting along the thread paths to a multiple thread sewing machine.

The attachment 10 as illustratively shown is formed with a support housing 12 having a base plate 14, longitudinal spaced end walls 16 and 17, side walls 19 and 20, and top wall 22. As shown the top wall 22, and side and end walls are preferably formed as a unitary continuous structure.

A variable speed drive 25, such as the ZERO MAX drive is arranged adjacent housing 12, with drive shaft 27 of the variable speed drive 25 extending towards the housing 12.

Figure 2:
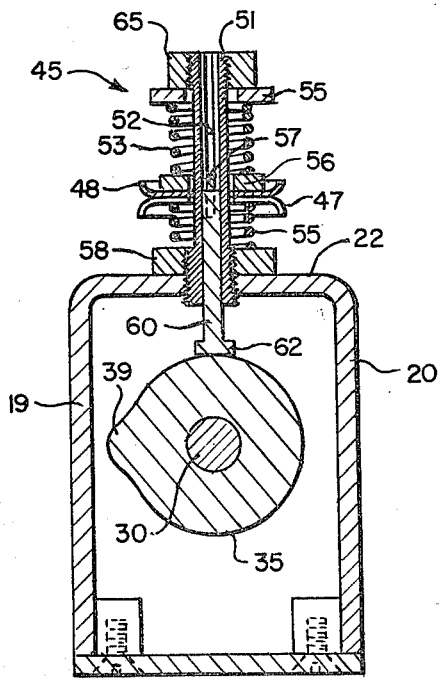
FIG. 2 is a cross-sectional view on line 2—2 of FIG. 1.

Cam shaft 30 is coupled to variable speed drive shaft 27 by shaft coupling 32, as seen to the left in FIG. 1. Cam shaft 30 extends through housing 12 and is journalled for rotation in bearing 34 on the housing end wall 17 remote from coupling 32. A plurality of cams 35, one for each thread of the multiple thread machine in connection with which the attachment is to be employed is arranged on the cam shaft 30. In the illustrated embodiment four cams 35 are shown formed with cam collars 36 having threaded openings 37 for set screws 38 to permit adjustable positioning of the cams 35 on cam shaft 30. The cams 35 as illustratively shown as best seen in FIG. 2 are formed with a high point 39.

Mounted on the top wall 22 of attachment housing 12 are thread tensioners 45, one for each thread of the multiple thread machine in connection with which the attachment is to be employed. The illustratively shown thread tensioners are of a type such as Reece TR 2 in which pressure plates 47 and 48 are mounted for movement on a hollow slotted tube 51 formed with slot 52 at its upper end. The lower end of tube 51 is threaded into housing top wall 22 with upper spring 53 and lower spring 55 biasing plates 47 and 48 towards each other. Upper spring 53 is sandwiched between upper disc washer 55 and lower disc washer 56 formed with cross-piece 57 riding in slot 51, while lower spring 55 is sandwiched between a lock nut 58 and lower pressure plate 47. Plunger 60 having cam follower head 62 at its lower end is arranged in slotted tube 51 with the upper end bearing against cross piece 57 of lower washer 56. Knurled adjusting knob 65 is threadedly engaged at the upper end of slotted tube 51.

OPERATION

In use the above described attachment 10 is positioned adjacent a multiple thread sewing machine which it is desired to use for decorative stitch pattern formation. The operation of machines such as the Willcox Gibbs Superlock 820 machine is found to be particularly enhanced by the use of attachments of the instant type.

With the above mentioned Willcox Gibbs Superlock 820 having a single needle and two looopers which may be used with either two or three threads, each thread used (whether two or three) is trained between plates 47 and 48 of a thread tensioner 45 of attachment 10, and the machine is theaded for use.

The variable speed drive is actuated and the sewing process may begin. As the cam shaft 30 rotates, for each rotation plunger 60 is raised at the high point 39 of cam 35 forcing plunger 60 up against cross-piece 57 of washer 56 releasing the spring pressure on plates 47 and 48 and the thread held therebetween. When thread pressure is released the amount of thread drawn through the sewn fabric is increased and the stiches are looser and the stitch pattern is formed with a greater width or amplitude. If the speed of the drive is increased the number of cycles of tightening and loosening of thread feed is increased for each unit length of fabric sewn, so that the number of repeats or frequency of repeat is increased with increased cam shaft r.p.m.

The thread tension is selectively adjustable by means of knurled adjustable nut 65 and cam positioning, while speed is selectively adjustable by means of the ZERO MAX.

Though a specific structure has been described and illustrated, it will be understood by those skilled in the art that the method of selectively controlling stitch pattern formation by selectively varying thread tension or the frequency of thread tension variation may be performed by a variety of other apparatus.

The above disclosure has been given by way of illustration and elucidation and not by way of limitation, and it is desired to protect all embodiments of the herein disclosed inventive concept within the scope of the appended claims.

What is claimed is:

1. A sewing machine attachment for forming decorative stitch patterns with multiple thread sewing machines forming a seam, said attachment comprising:

a variable speed drive independent of the sewing machine;

a cam shaft coupled to said variable speed drive to be driven thereby;

a plurality of cams on said cam shaft movable therewith;

a high point on each cam;

a plurality of pairs of thread tensioning pressure plates between which the threads of the machine in connection with which the attachment is to be used are guided;

springs urging said pressure plates towards each other into thread engaging position; and a plunger arranged to follow and be moved by said cams, said plunger coupled to said springs to effect the spring pressure exerted by said springs on said pressure plates.

2. A sewing machine attachment as in claim 1 in which the pressure between said thread tensioner pressure plates is selectively variable.

3. A sewing machine attachment as in claim 1 in which the position of said cams on said cam shaft is selectively adjustable.

4. A sewing machine attachment as in claim 1 in which the speed of said drive is selectively variable.

5. A method of forming decorative stitch patterns with different amplitudes and repeat frequencies with a multiple thread sewing machine forming a seam, said method comprising the steps of:

periodically changing the amplitude of the stitch pattern by varying thread tension; and periodically changing the frequency of repeat of the stitch pattern.

6. A method as in claim 5 in which said step of changing frequency is performed by varying the number of times by which thread tension is changed in each unit length of sewn material passing through the sewing machine.

* * * * *